US008707562B2

(12) United States Patent
Coffin

(10) Patent No.: US 8,707,562 B2
(45) **Date of Patent: *Apr. 29, 2014**

(54) WET SHAVING CARTRIDGE WITH FOUR BLADE EDGES

(75) Inventor: David C. Coffin, Hamden, CT (US)

(73) Assignee: Eveready Battery Company, St. Lois, MO (US)

( * ) Notice: Subject to any disclaimer, the term of this patent is extended or adjusted under 35 U.S.C. 154(b) by 1273 days.

This patent is subject to a terminal disclaimer.

(21) Appl. No.: 11/873,930

(22) Filed: Oct. 17, 2007

(65) Prior Publication Data

US 2008/0034593 A1 Feb. 14, 2008

Related U.S. Application Data

(63) Continuation of application No. 11/336,340, filed on Jan. 20, 2006, now abandoned, which is a continuation of application No. 10/782,173, filed on Feb. 18, 2004, now Pat. No. 7,047,646, which is a continuation of application No. 10/132,536, filed on Apr. 24, 2002, now abandoned.

(60) Provisional application No. 60/287,100, filed on Apr. 27, 2001.

(51) Int. Cl.
*B26B 21/00* (2006.01)
*B26B 21/54* (2006.01)

(52) U.S. Cl.
USPC ..... 30/50; 30/346.55; 30/346.57

(58) Field of Classification Search
USPC ..... 30/47, 50, 57, 77, 346.5, 346.57, 30/346.55
See application file for complete search history.

(56) References Cited

U.S. PATENT DOCUMENTS

| | | | | |
|---|---|---|---|---|
| 3,660,893 | A | 5/1972 | Welsh | |
| 3,786,563 | A | 1/1974 | Dorion et al. | |
| 3,871,073 | A | 3/1975 | Nissen et al. | |
| 4,069,580 | A | 1/1978 | Emmett | |
| 4,146,958 | A * | 4/1979 | Chen et al. | 30/47 |

(Continued)

FOREIGN PATENT DOCUMENTS

| | | |
|---|---|---|
| FR | 634.488 | 2/1928 |
| FR | 821.030 | 11/1937 |

(Continued)

OTHER PUBLICATIONS

Extended European Search Report dated Mar. 11, 2010 for EP application 10154233.0.

*Primary Examiner* — Laura M Lee
(74) *Attorney, Agent, or Firm* — Energizer Personal Care, LLC

(57) ABSTRACT

A razor cartridge is provided that includes a frame, at least four razor blades, a guard that includes a contact surface, and a cap that includes a contact surface. The razor blades are supported by the frame. The guard is disposed forward of the razor blades and the cap is disposed aft of the razor blades. The razor blades are arranged so that the cutting edge of each razor blade is adjacent a plane that tangentially intersects the contact surfaces of the guard and the cap. As a result, each stroke of the razor exposes the surface being shaved to at least four razor blade cutting edges in succession. A unitary razor assembly that includes a head characterized in the same manner as the above-described cartridge is also provided.

7 Claims, 5 Drawing Sheets

(56) References Cited

U.S. PATENT DOCUMENTS

| | | | | | |
|---|---|---|---|---|---|
| 4,407,067 | A | | 10/1983 | Trotta | |
| 4,741,103 | A | | 5/1988 | Hultman | |
| 4,831,731 | A | * | 5/1989 | Elits | 30/50 |
| 5,018,274 | A | | 5/1991 | Trotta | |
| 5,426,851 | A | * | 6/1995 | Gilder et al. | 30/50 |
| 5,524,346 | A | | 6/1996 | Backhaus | |
| 5,630,275 | A | * | 5/1997 | Wexler | 30/50 |
| 5,661,907 | A | * | 9/1997 | Apprille, Jr. | 30/47 |
| 5,669,144 | A | | 9/1997 | Hahn et al. | |
| 5,822,862 | A | * | 10/1998 | Ferraro | 30/50 |
| 6,212,777 | B1 | * | 4/2001 | Gilder et al. | 30/50 |
| 6,276,062 | B1 | | 8/2001 | Prochaska | |
| 6,378,211 | B1 | | 4/2002 | Wonderley | |
| 6,655,030 | B2 | * | 12/2003 | Zuidervaart | 30/50 |
| 7,047,646 | B2 | * | 5/2006 | Coffin | 30/50 |

FOREIGN PATENT DOCUMENTS

| | | | | | |
|---|---|---|---|---|---|
| GB | 2354474 | | * | 3/2001 | B26B 21/22 |
| JP | S 58-88974 | | | 6/1983 | |
| JP | S 63-52911 | | | 10/1988 | |
| JP | H10-290891 | | | 11/1998 | |
| JP | 3512417 | B | | 3/2004 | |
| WO | WO92/17322 | | | 10/1992 | |
| WO | WO 95/09071 | | * | 4/1995 | B26B 21/22 |
| WO | WO95/09071 | A1 | | 4/1995 | |
| WO | WO99/39883 | A1 | | 8/1999 | |
| WO | WO 00/64644 | | * | 11/2000 | B26B 21/56 |

* cited by examiner

WET SHAVING CARTRIDGE WITH FOUR BLADE EDGES

CROSS-REFERENCE TO RELATED APPLICATIONS

This application is a continuation of U.S. patent application Ser. No. 11/336,340, filed on Jan. 20, 2006, which is a continuation of U.S. patent application Ser. No. 10/782,173 filed on Feb. 18, 2004, now U.S. Pat. No. 7,047,646, which is a continuation of U.S. patent application Ser. No. 10/132,536 filed on Apr. 24, 2002, now abandoned, which is entitled to the benefit of priority of U.S. Provisional Patent Application No. 60/287,100 filed on Apr. 27, 2001, the contents of each application being incorporated herein by reference in their entireties.

BACKGROUND OF THE INVENTION

1. Technical Field

This invention relates to shaving devices in general, and to shaving devices having multiple blades in particular.

2. Background Information

Modern safety razors include one to three blades disposed within a head that is mounted on a handle. Some safety razors have a disposable cartridge head and others have a handle and head that are combined into a unitary disposable. Although a variety of razor head configurations exist, razor heads typically include a frame made of a rigid plastic and one to three blades mounted in the frame. The frame includes a seat portion and a cap portion, and the one to three blades are disposed between the cap and the seat. The head further includes a guard disposed forward of the blade so that the person's skin encounters the guard prior to encountering the blade. The cap is disposed aft of the blade(s) so that the person's skin encounters the cap after encountering the blade. The guard and the cap orient the position of the person's skin relative to the blade(s) to optimize the shaving action of the blade. Modern safety razors are also known to include one or more comfort strips attached to the head. Comfort strips typically include an insoluble material mixed with a soluble material. In some instances, the soluble material itself facilitates the shaving process, and in other instances one or more shaving aid agents (e.g., lubricating agents, drag reducing agents, depilatory agents, cleaning agents, medicinal agents, etc) are added to the comfort strip to further enhance the shaving process.

The comfort and performance provided by a particular razor are critical to the commercial success of the razor. Improvements that benefit razor comfort and/or performance, however significant or subtle, can have a decided impact on the commercial success of a razor. One of the ways to increase the comfort of the razor is to reduce the number of strokes necessary to complete the shave. Each stroke of the razor provides an opportunity to irritate or cut the skin of the person being shaved. One of the ways to decrease the number of strokes necessary to complete the shave is to improve the performance of the razor. A razor that satisfactorily shaves the hair in a single stroke performs better that a razor that requires a plurality of strokes to provide the same shave. It would be desirable, therefore, to provide a razor that outperforms existing razors, and one that is more comfortable to use than existing razors.

DISCLOSURE OF THE INVENTION

It is, therefore, an object of the present invention to provide a razor that provides improved performance relative to existing razors, and one that is more comfortable to use than existing razors.

According to the present invention, a razor cartridge is provided that includes a frame, at least four razor blades, a guard that includes a contact surface, and a cap that includes a contact surface. The frame supports the razor blades. The guard is disposed forward of the razor blades and the cap is disposed aft of the razor blades. The razor blades are arranged so that the cutting edge of each razor blade is adjacent a plane that tangentially intersects the contact surfaces of the guard and the cap. As a result, each stroke of the razor exposes the surface being shaved to at least four razor blade cutting edges in succession. A unitary razor assembly that includes a head characterized in the same manner as the above-described cartridge is also provided. Hereinafter, the razor cartridge and razor assembly will be collectively described in terms of a cartridge unless otherwise specified.

The four or more razor blades of the present invention cartridge and razor assembly provide several advantages over currently available razor cartridges and razor assemblies. Most modern safety razors include one to three razor blades disposed between a guard and a cap. The cutting edge of each razor blade is positioned adjacent a plane (i.e., the "contact plane") that tangentially intersects the contact surfaces of the guard and the cap. The contact plane represents the theoretical position of the surface being shaved. The position of a razor blade's cutting edge relative to the contact plane is described in terms of the "exposure" of the cutting edge. A cutting edge with "positive exposure" is one where the blade and its cutting edge extend through the plane and into the area normally occupied by the object being shaved. A cutting edge with "negative exposure" is one where the cutting edge of the blade is positioned below the plane and therefore does not intersect the contact plane. A blade with "neutral exposure" is one where the cutting edge of the blade is contiguous with the contact plane. In a single blade razor, the single blade must cut each hair at the prescribed height in one pass, or cut sections of each hair in multiple passes until the prescribed height of each of those hairs is reached. If the single blade razor is designed to cut at the prescribed height in a single pass, it is likely to have a substantial positive exposure. A problem with positioning a blade at a substantial positive exposure is that it increases the chance of skin irritation. On the other hand, if the single blade razor is positioned to have a slight positive, neutral, or negative exposure, the likelihood of irritation in one pass is diminished. However, the closeness of the shave possible with a single pass is also diminished, making it necessary to pass the razor over the same surface multiple times, which also increases the chance of skin irritation.

The present invention, in contrast, exposes the surface to be shaved to at least four razor blades in succession. The blades can be positioned in a variety of different exposure configurations to provide different "feels" or to tune the razor for different applications. In all cases, the work of cutting the hairs is distributed among the four or more razor blades. Each razor cuts a portion of the hairs and collectively the desired closeness of shave is provided in a single pass. The chance of irritation is consequently reduced.

The four or more blades of the present invention and the different blade exposure configurations possible therewith provide a multitude of options not possible with the one to three blade razors presently available. As stated above, there is a relationship between the exposure of the blade(s) and the chance of irritation, and a relationship between the number of razor passes and the chance of irritation. The present invention makes it possible to decrease the exposure of the blade(s) and the necessity to make multiple passes over the same skin surface. As a result, the chance of irritation is greatly reduced and the comfort and performance of the shaving device is improved.

In addition, the four or more blades of the present invention make it possible to provide a range of blade exposures not practically possible with two or three bladed razors. If, for example, the maximum amount of acceptable exposure change between adjacent blades is 0.2 mm, then a three bladed razor cartridge has a maximum collective blade exposure of 0.6 mm. Under the present invention, in contrast, the same maximum collective blade exposure would be 0.8 mm or greater. This increased range makes it possible, for example, to position the forward-most blade at a substantial negative exposure and the aft-most blade at a substantial positive exposure.

Another configuration possible with the present razor cartridge is one in which the range of razor blade exposure is similar to that found in presently available two or three bladed razors, but the amount of exposure change between adjacent blades is reduced. In this configuration, increased comfort and performance are provided because the amount of hair removed per blade is reduced.

Other configurations possible with the present razor cartridge include alternating blade exposures, or blades with incrementally decreasing or increasing blade exposure, or blades having different sharpnesses, or a cartridge having non-uniform interblade spacing.

These and other objects, features, and advantages of the present invention will become apparent in light of the detailed description of the present invention.

DETAILED DESCRIPTION OF THE INVENTION

Figure 1:
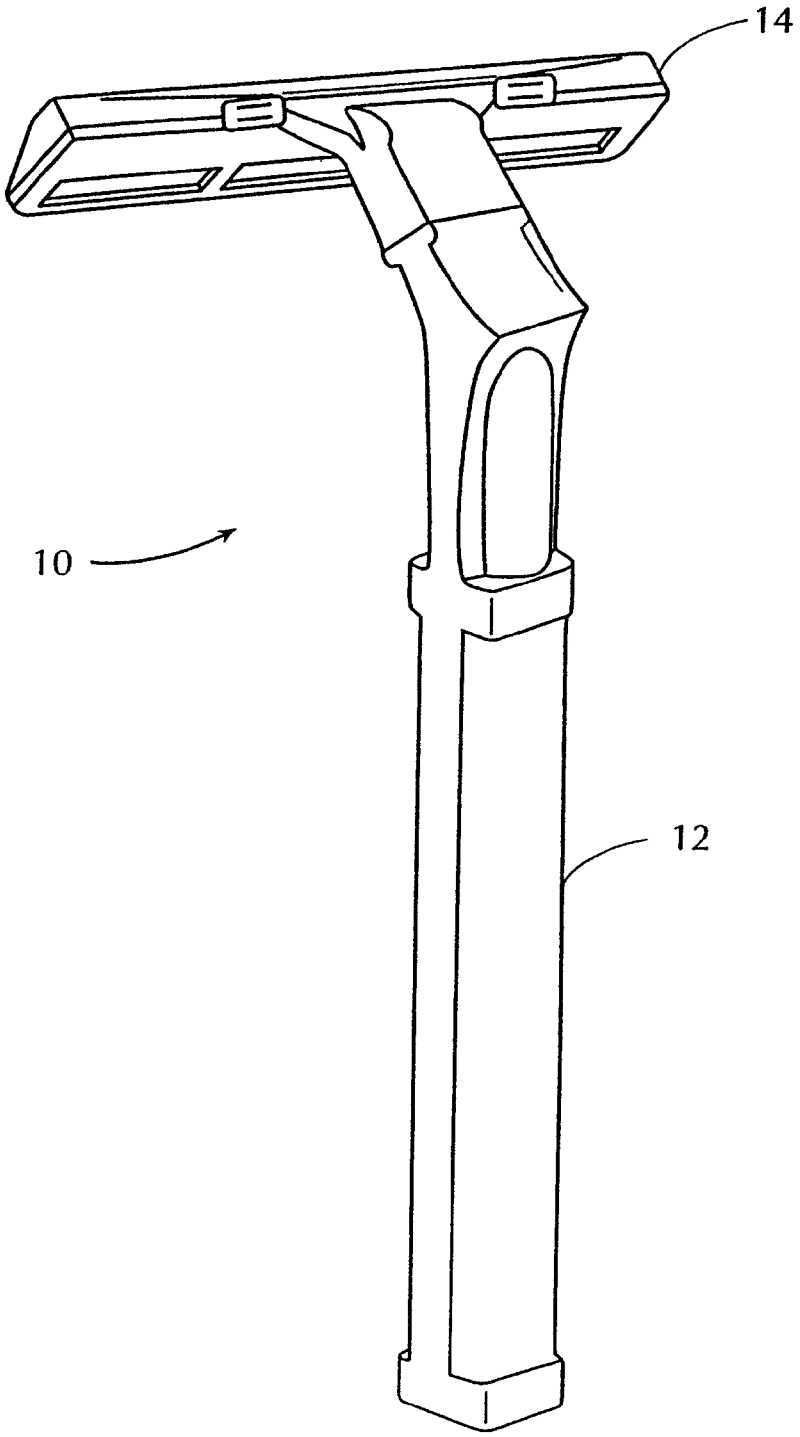
FIG. 1 is a diagrammatic view of a unitary razor.
Figure 2:
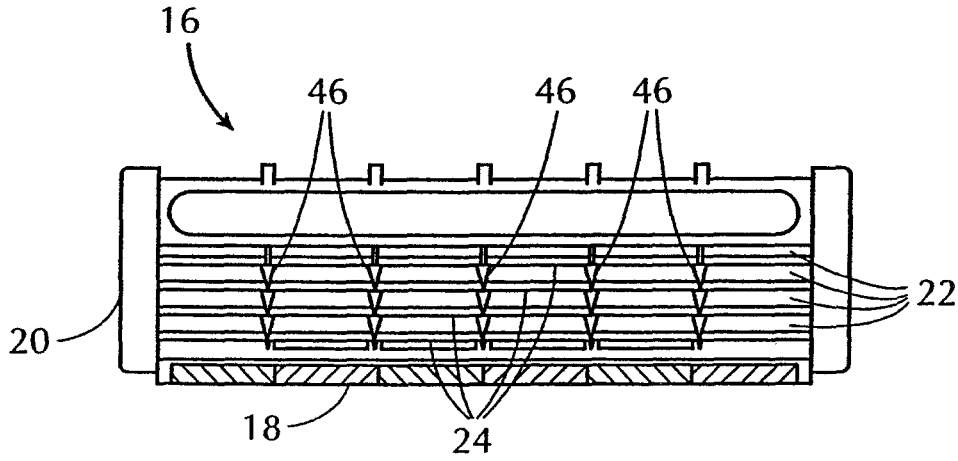
FIG. 2 is a diagrammatic top view of a razor cartridge.
Figure 3:
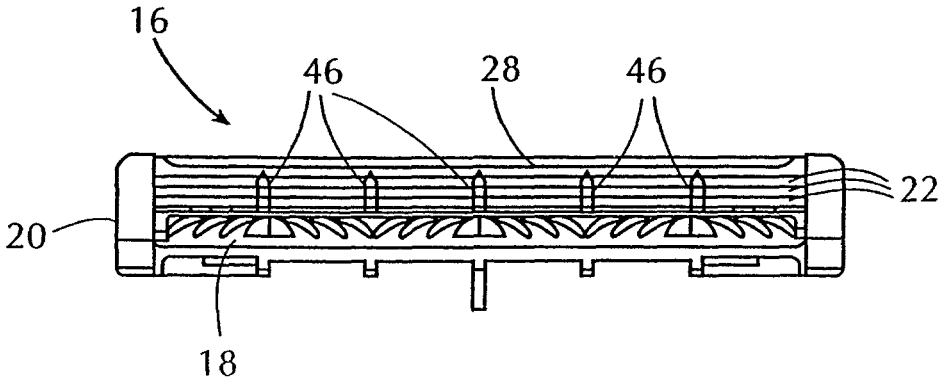
FIG. 3 is a diagrammatic front view of a razor cartridge.

Referring to FIGS. 1-3, a razor assembly 10 (see FIG. 1) includes a handle 12 and head 14 attached to one another. The head 14 can be permanently attached to the handle 12 or it can be removably attached to the handle 12 as a replacement cartridge 16 (see FIGS. 2 and 3). In both instances, the attachment can be rigid or a pivot-type attachment. To facilitate this detailed description, the present invention will be described in terms of a replaceable cartridge 16. However, the present invention can also assume the form of a unitary razor assembly having a handle and a head.

Referring to FIGS. 2-5, the cartridge 16 includes a guard 18, a frame 20, and four or more razor blades 22 mounted within the frame 20. Each razor blade 22 has a cutting edge 24 that extends along the length of the blade 22. The frame 20 includes a seat 26, a cap 28, and a plurality of spacers 30. The razor blades 22 are disposed between the seat 26 and the cap 28 of the frame 20. The cap 28 includes an exterior contact surface 32. The terms "forward" and "aft", as used herein, define relative position between two or more things. A feature "forward" of the razor blades 22, for example, is positioned so that the surface to be shaved encounters the feature before it encounters the razor blades 22, assuming that the cartridge 16 is being stroked in its intended cutting direction. The guard 18 is attached to the frame 20 forward of the cutting edges 24 of the razor blades 22. A feature "aft" of the razor blades 22 is positioned so that the surface to be shaved encounters the feature after it encounters the razor blades 22, assuming that the cartridge 16 is being stroked in its intended cutting direction. The cap 28 is disposed aft of the cutting edges 24 of the razor blades 22.

The spacers 30 are disposed between the razor blades 22 to space the razor blades 22 apart from one another by a distance equal to the height of the spacers 30. In some embodiments, the height of the spacers 30 between different pairs of razor blades 22 are varied to change the spacing between adjacent razor blades 22 as will be discussed in greater detail below. In some embodiments, the spacers 30 are shaped so that the razor blades 22 they separate are widthwise parallel with each other. In other embodiments, the spacers 30 are shaped so that the razor blades 22 they separate are widthwise skewed relative to each other; i.e., they diverge from one another traveling away from the cutting edge 24.

A variety of guards 18 can be used with the present invention. Guards are well known in the art and will therefore not be discussed further here other than to say the present invention is not limited to being used with any particular type of guard. The guard includes an exterior contact surface 34.

Figure 4:
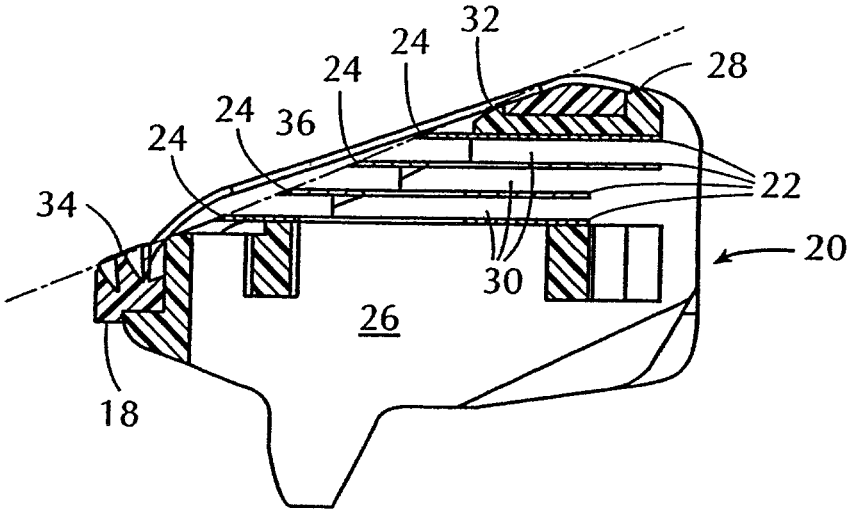
FIG. 4 is a diagrammatic cross-sectional view of a razor cartridge having four razor blades.
Figure 5:
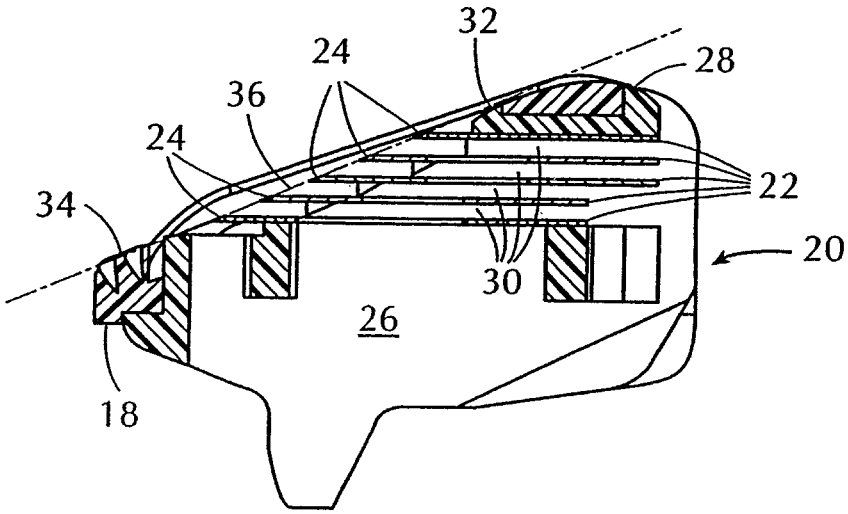
FIG. 5 is a diagrammatic cross-sectional view of a razor cartridge having five razor blades.

Now referring to FIGS. 4-6, the cutting edge 24 of each razor blade 22 is positioned adjacent the contact plane 36 that tangentially intersects the exterior contact surfaces 32,34 of the guard 18 and the cap 28. In one embodiment of the present invention (see FIG. 5), the cutting edges 24 of the razor blades 22 are contiguous with the contact plane; i.e., they each have a neutral exposure. In another embodiment (see FIGS. 6A, 6B, 6D, and 6E), the exposure of the four razor blades 22 increases from the forward-most razor blade to the aft-most razor blade; i.e., each of the four razor blades has a greater amount of exposure than the razor blade of which it is positioned aft. The forward-most razor blade 22 can be positioned to have a negative exposure, a neutral exposure, or a positive exposure and the other razor blades 22 are relatively positioned. FIG. 6A shows an equal amount of change of exposure from razor blade 22 to razor blade 22, beginning with the forward-most razor blade to the aft-most razor blade. In another embodiment (see FIG. 6C), the exposure of the four razor blades 22 can alternate; e.g., the forward-most razor blade 22 has a negative exposure; the next aft razor blade 22 has a positive exposure; the next aft blade 22 has a negative exposure; and the next aft razor blade 22 (which in a four blade embodiment is the aft-most blade) has a negative exposure. In still another embodiment (see FIG. 6D), the amount of change of exposure from razor blade 22 to razor blade 22, forward to aft, varies to suit the application. In a four blade cartridge 16, for example, the second razor blade 40 which is adjacent the forward-most first razor blade 38 might have an exposure that is "x" amount greater than that of the forward-most first razor blade 38; the next aft third razor blade 42 might have an exposure that is "y" amount greater than that of the second razor blade 40; and the aft-most fourth razor blade 44 might have an exposure that is "z" amount greater than that of the third razor blade 42; where x>y>z. The position of the razor blades can also be collectively adjusted relative to the contact plane 36, while maintaining the aforesaid "x, y, z" relative positioning. In this embodiment, the four razor blades 22 provides better performance than is possible with fewer razor blades 22 and the diminishing exposure of each razor blade 22 in the aft direction provides improved comfort for the person shaving. The decreasing rate of exposure from razor blade 22 to razor blade 22 also provides increased safety for those razor cutting edges positioned closer to the surface being shaved.

Figure 6A:
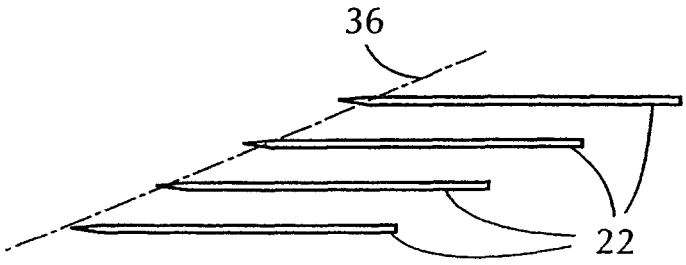
FIGS. 6A-6E are diagrammatic views of razor blades relative to a contact plane.
Figure 6B:
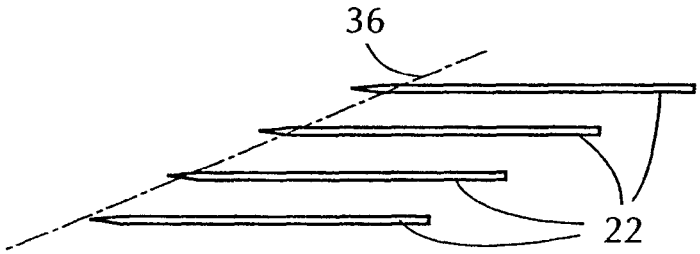
Figure 6C:
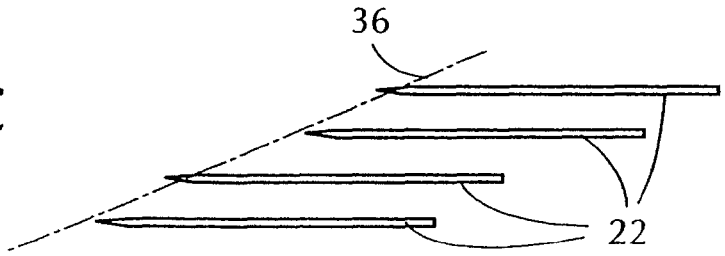
Figure 6D:
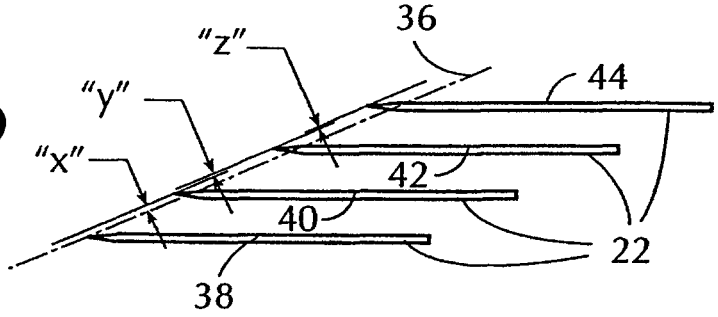
Figure 6E:
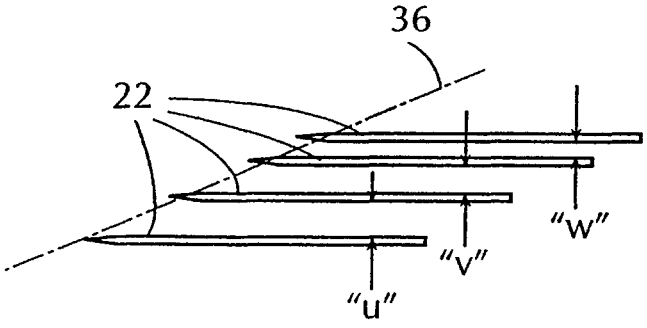

Adjacent razor blades 22 within the four or more razor blades 22 of the present cartridge 16 are typically equally spaced apart from one another. In some instances, however, it is desirable to utilize non-uniform interblade spacing. For example, FIG. 6E diagrammatically shows four razor blades 22 spaced apart from one another by distances "u, v, and w", where u>v>w. The decreased interblade spacing provides greater comfort, and at the same time the four or more razor blades 22 of the present cartridge provide increased performance. As stated above, in some instances it may also be desirable to skew the angle between adjacent blades so that the adjacent blades 22 are not widthwise parallel to one another, but rather diverge from one another traveling in the widthwise direction, away from the cutting edge 24. The diverging blades 22 facilitate the removal of debris generated during the shaving process.

The four or more razor blades 22 of the present cartridge are typically made of the same material and each has a cutting edge 24 with a sharpness similar to that of the other razor blades 22. In some embodiments of the present cartridge 16, however, the materials of the razor blades 22 and/or their sharpness are varied to provide advantageous characteristics. For example, the forward first and second razor blades 22 can be made with a sharpness greater than that of the aft third and fourth razor blades 22. This arrangement is particularly desirable if the razor blades 22 having increased sharpness (i.e., the first and second) are positioned with negative or neutral exposure and the razor blades 22 having a standard sharpness (i.e., the third and fourth) are positioned with a positive exposure. The number of razor blades 22 allows the increased sharpness razor blades to be positioned away from surface being shaved and the standard sharpness razor blades to be positioned in close proximity to the surface being shaved, relatively speaking. The number of razor blades in this embodiment permits the sharper razor blades to operate where they are less apt to create irritation and still provide the improved performance, and the standard sharpness blades, which are less apt to cause irritation, to operate in a position where they can closely shave the surface. In a similar manner, the materials of the razor blades 22 can be varied to provide increased performance and/or comfort. For instances, in the above described example the razor blades 22 having a standard sharpness (i.e., the third and fourth) might include a coating that increases their durability.

Now referring to FIGS. 2 and 3, in some embodiments the cartridge 16 further includes a plurality of skin flow members 46 disposed between adjacent razor blades 22. The skin flow members 46 can be positioned with a positive, neutral, or a negative exposure. The skin flow members 46 engage the surface being shaved and help orient it relative to the razor blades 22.

Although this invention has been shown and described with respect to the detailed embodiments thereof, it will be understood by those skilled in the art that various changes in form and detail thereof may be made without departing from the spirit and scope of the invention.

What is claimed is:

1. A razor cartridge, comprising:

a frame having a guard including a contact surface and a cap including a contact surface; and at least first, second, third and fourth razor blades, each having a cutting edge, disposed sequentially between the guard and the cap;

wherein the guard is disposed forward of the cutting edge of the first razor blade; and the cap is disposed aft of the cutting edge of the fourth razor blade; and wherein the cutting edge of the first razor blade has a sharpness greater than the sharpness of the cutting edge of the fourth razor blade.

2. The razor cartridge of claim 1, wherein the sharpness of the cutting edge of the second razor blade is greater than the sharpness of the cutting edge of the third razor blade.

3. The razor cartridge of claim 1, wherein the sharpness of the cutting edge of the first razor blade is greater than the sharpness of the cutting edge of the third razor blade.

4. The razor cartridge of claim 2, wherein the sharpness of the cutting edge of the second razor blade is greater than the sharpness of the cutting edge of the fourth razor blade.

5. The razor cartridge of claim 1, wherein the cutting edge of the first razor blade defines a negative exposure relative to a plane tangent to the contact surface of the guard and the contact surface of the cap.

6. The razor cartridge of claim 5, wherein the cutting edge of the fourth razor blade defines a positive exposure relative to a plane tangent to the contact surface of the guard and the contact surface of the cap.

7. The razor cartridge of claim 6, wherein the cutting edge of the third razor blade defines a positive exposure relative to a plane tangent to the contact surface of the guard and the contact surface of the cap.

* * * * *